United States Patent [19]

Neuber et al.

[11] 4,040,708

[45] Aug. 9, 1977

[54] CATHODE RAY TUBE BASE

[75] Inventors: Ralph E. Neuber; Charles H. Rehkopf, both of Seneca Falls, N.Y.

[73] Assignee: GTE Sylvania Incorporated, Stamford, Conn.

[21] Appl. No.: 702,096

[22] Filed: July 2, 1976

[51] Int. Cl.[2] ..... H01R 13/46

[52] U.S. Cl. ..... 339/111; 313/318; 339/143 T; 339/193 R

[58] Field of Search ..... 313/318; 339/111, 143 R, 339/143 T, 145 T, 192 T, 193, 194

[56] References Cited

U.S. PATENT DOCUMENTS

| | | | |
|---|---|---|---|
| 1,850,559 | 3/1932 | Marshall | 339/194 R |
| 2,659,061 | 11/1953 | Mirabella | 339/192 T |
| 3,867,671 | 2/1975 | Johnson | 339/111 |
| 3,958,854 | 5/1976 | Arrington | 339/111 |
| 3,979,157 | 9/1976 | DiMattio | 313/318 |

*Primary Examiner*—Roy Lake
*Assistant Examiner*—Mark S. Bicks
*Attorney, Agent, or Firm*—Norman J. O'Malley; William H. McNeill; Robert T. Orner

[57] ABSTRACT

A base for a cathode ray tube includes a rubber washer having apertures of a size to fix over the glass nubbins surrounding the bottom of the tube pins where they exit from the neck of the tube. The base also includes a walled rim which contains the washer.

3 Claims, 2 Drawing Figures

CATHODE RAY TUBE BASE

BACKGROUND OF THE INVENTION

This invention relates to tube bases and more particularly to tube bases for cathode ray tubes which employ high voltage differentials between various tube pins.

Current and projected types of cathode ray tubes, particularly those employed in color television, have a small diameter neck containing the electron gun or guns. The necessary operating voltages for the various elements of these guns (heaters, cathodes, grids, focusing electrodes, etc.) are supplied via tube pins which are sealed into the end of the tube. As higher voltage guns have developed and the neck diameter has gotten smaller, decreasing from 36mm to 29mm, it has dictated that the tube pins, which are annularly arrayed thereabout, keep getting closer together.

Prior art tubes have always had large voltage differentials, sometimes on the order of 5 KV to 8 KV between various tube pins. Furthermore, if an arc originates between the anode and focus grid, the focus grid momentarily assumes anode potential (up to 30 KV) and this voltage can progress to the tube pins resulting in arcing from the focus pin to an adjacent pin, often damaging cathode emission. This subsequent arcing often occurs in the restricted area between the plastic base and the glass stem of the cathode ray tube. The intense heat developed by the arc results in a condition called "tracking"; a breakdown of the plastic base into a carbonaceous residue between the arcing pins, which results in a subsequent low insulation resistance.

Previously, it was attempted to control this arcing by surrounding a high voltage tube pin with an RTV; i.e., a room temperature vulcanizing silicone rubber. However, this process is difficult to control and required a trained operator. Additionally these high voltage connections have usually had some form of arc protection incorporated into the female socket, see, for example, U.S. Pat. Nos. 3,466,491 and 3,466,492. Such protection however, has proven incapable of providing adequate protection for the newer tube types.

OBJECTS AND SUMMARY OF THE INVENTION

Accordingly, it is an object of this invention to obviate the disadvantages of the prior art.

It is another object of the invention to enhance voltage protection in cathode ray tubes.

Yet another object of the invention is to prevent or alleviate inter-pin arcing in cathode ray tubes.

Yet another object of the invention is the provision of a tube base which includes arcing protection.

These objects are accomplished in one aspect of the invention by the provision of a base for a cathode ray tube which includes an electrically insulating washer confined within a walled rim of a plastic base. Provision is made therein for the projection therethrough of the tube pins. The compressible washer fills the voids between tube pins at the glass-base interface and provides an effective arcing deterent.

DESCRIPTION OF THE PREFERRED EMBODIMENTS

For a better understanding of the present invention, together with other and further objects, advantages, and capabilities thereof reference is made to the following disclosure and appended claims taken in conjunction with the above-described drawings.

Figure 1:
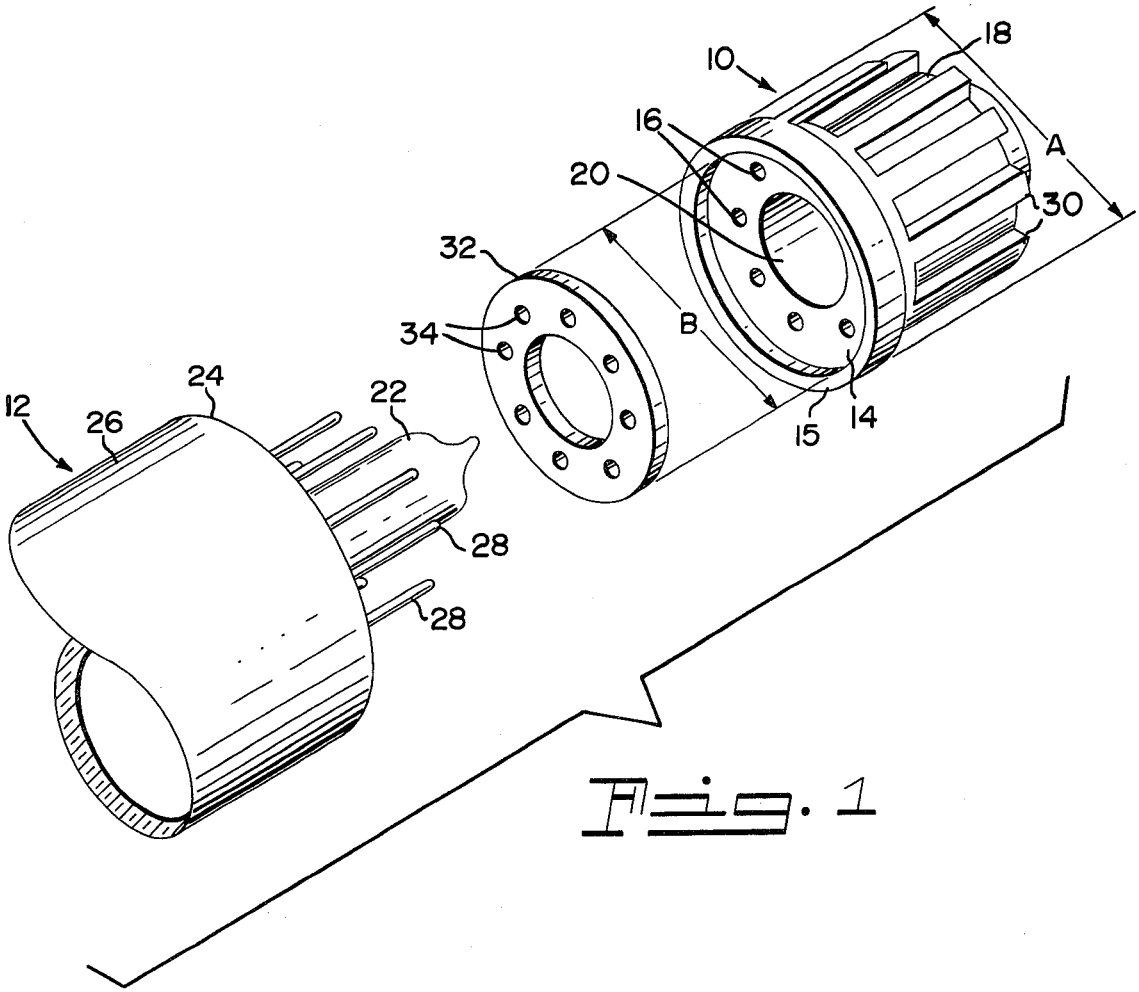
FIG. 1 is an exploded perspective view of a base in accordance with an embodiment of the invention.

Referring now to the drawings with greater particularity there is shown in FIG. 1 a base 10 for a cathode ray tube 12. The base 10 comprises a circular rim 14 surrounded by a circumferential wall 15 having an outer diameter A and an inner diameter B. A plurality of tube pin receiving apertures 16 extend through the rim 14 and are spaced inwardly from the inner circumference of wall 15 in an annular array.

Figure 2:
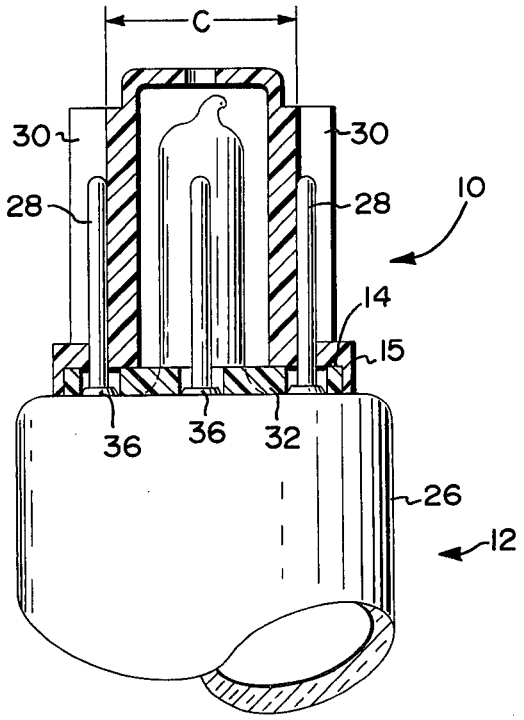
FIG. 2 is an elevational view of a base and CRT neck, with some parts in section.

A hollow, substantially centrally located crown 18 is positioned on rim 14 and extends rearwardly therefrom, the internal portion 20 thereof being adapted to receive the terminus of an exhaust tubulation 22 formed at the end 24 of the neck 26 of cathode ray tube 12. The outside circumference of crown 18 has a diameter C equal to the diameter of the inside edges of the tube pin receiving apertures 16; thus, when base 10 is in position on the neck 26, the inside edges of the tube pins 28 ride on the outside circumference of crown 18 (see FIG. 2).

Crown 18 is also provided with a plurality of radially extending fins 30 which are located between the apertures 16 forming pockets therefor and adding further arcing protection.

The base 10 further includes an electrically insulating soft washer 32 of a suitable material such as sponge rubber or silicone rubber. Washer 32 contains a plurality of apertures 34 matching in number and location the tube pin receiving apertures 16. The diameter of the apertures 34 is larger than the diameter of the tube pins 28 and closely matches the diameter of glass nubbins 36 formed at the base of pins 28. It has been found necessary for the stated purpose of arc prevention for the diameter of the apertures 34 to closely match that of glass nubbins 38 to eliminate air gaps. When excessively smaller or larger apertures are employed the desired seal is imperfect and arcing will result.

While the thickness of washer 32 is variable within about 0.010 to 0.050 inch, it has been found that 0.040 inch is preferred. It is also preferred that the internal height of wall 15 is 0.010 to 0.020 inch less than that of washer 32 so that the washer is substantially enclosed and extends above wall 15 so that the washer can be placed in compression.

A suitable adhesive, such as rubber cement or an RTV is used to adhere the washer 32 to base 10 and the entire assembly to neck 26.

It will be seen from the above that there is herein provided a new and novel form of arc protection incorporated in a tube base.

While there has been shown and described what is at present considered to be the preferred embodiment of the invention, it will be obvious to those skilled in the art that various changes and modifications may be made therein without departing from the scope of the invention as defined by the appended claims.

What is claimed is:

1. In combination, a cathode ray tube and a base therefor, said cathode ray tube having a cylindrical terminal portion closed by a substantially planar wall provided with a plurality of annularly arrayed, spaced, projecting tube pins each surrounded by a raised circumferential nubbin with a diameter larger than said pins where said pins exit from said wall, said base comprising: a circular rim having a given diameter surrounded by a peripheral wall having a given internal wall height; a plurality of tube pin receiving apertures extending through said rim, said apertures being spaced inwardly from the inner circumference of said peripheral wall and being annularly arrayed; a hollow, substantially centrally located crown positioned on said rim on a side opposite said peripheral wall and projecting therefrom, the internal portion of said crown being adapted to receive the terminus of an exhaust tubulation, the outside circumference of said crown having a diameter equal to the diameter of the inside edges of said tube pin receiving apertures and being further provided with a plurality of radially extending fins, said fins being located between said apertures; and an electrically insulating, soft washer fitted within said peripheral wall, said washer having a thickness greater than the internal height of said peripheral wall and being further provided with a plurality of apertures matching in number and location said tube pin receiving apertures in said rim, said apertures having a diameter closely matching the diameter of said nubbins.

2. The combination of claim 1 wherein said thickness of said washer exceeds the height of said peripheral wall by about 0.010 and 0.020 inch.

3. The base of claim 2 wherein said washer is formed from sponge rubber or silicone rubber.

* * * * *